US010774626B2

(12) United States Patent
Suttipisetchart et al.

(10) Patent No.: US 10,774,626 B2
(45) Date of Patent: Sep. 15, 2020

(54) PLUNGER FOR GAS LIFT SYSTEM WITH NOVEL SKIRT

(71) Applicant: 1069416 ALBERTA LTD., Calgary (CA)

(72) Inventors: Watcharin Suttipisetchart, Calgary (CA); Stephen Vetter, Calgary (CA)

(73) Assignee: 1069416 ALBERTA LTD., Calgary (CA)

( * ) Notice: Subject to any disclaimer, the term of this patent is extended or adjusted under 35 U.S.C. 154(b) by 107 days.

(21) Appl. No.: 14/464,442

(22) Filed: Aug. 20, 2014

(65) Prior Publication Data

US 2015/0053427 A1 Feb. 26, 2015

Related U.S. Application Data

(60) Provisional application No. 61/869,352, filed on Aug. 23, 2013.

(51) Int. Cl.
*E21B 43/12* (2006.01)

(52) U.S. Cl.
CPC ..... *E21B 43/121* (2013.01); *E21B 43/122* (2013.01); *E21B 43/123* (2013.01)

(58) Field of Classification Search
CPC ..... E21B 43/121; E21B 43/122
USPC ..... 166/372
See application file for complete search history.

(56) References Cited

U.S. PATENT DOCUMENTS 5,427,504 A * 6/1995 Dinning ..... E21B 43/121 417/59
6,725,916 B2 4/2004 Gray
2003/0155129 A1* 8/2003 Gray ..... E21B 43/121 166/370
2012/0080196 A1 4/2012 Laing

OTHER PUBLICATIONS

T-Pad Plungers, http://www.weatherford.com/Products/Production/PlungerLift/T-PadPlungers/, 2013.
Subsurface Equipment—Plungers; http://www.fergusonbeauregard.com/products/plungers/miniflex.html, 2013.

* cited by examiner

*Primary Examiner* — Giovanna Wright
*Assistant Examiner* — Manuel C Portocarrero
(74) *Attorney, Agent, or Firm* — Bennett Jones LLP

(57) ABSTRACT

A plunger with expandable mating pad elements arrayed circumferentially about the plunger's body sealed to the plunger and biased to expand the plunger assembly's outer circumferential surface toward the inner surface of the tubular within which the plunger assembly is designed to operate. The gaps between the pad elements are minimized by having the adjacent pad elements slidable against each other along two sets of surfaces along essentially the length of the interface between adjacent pad elements, one surface set being approximately axial to the plunger and the other set being approximately radial to the plunger's longitudinal axis, and in this way reducing the available pathway in the gap between adjacent pad elements for fluid to bypass the plunger assembly.

13 Claims, 4 Drawing Sheets

PLUNGER FOR GAS LIFT SYSTEM WITH NOVEL SKIRT

FIELD OF THE INVENTION

The invention disclosed herein relates to improvements in plungers used in gas/fluid lift systems in wells producing both fluids and gases, such as petroleum and natural gas, under variable pressures. More specifically, the present invention is concerned with a pad subassembly of a particular configuration for sealingly and slidingly engaging a plunger within the well tubulars.

BACKGROUND OF THE INVENTION

Petroleum and natural gas producing wells typically employ a plunger disposed within tubing of the well. The plunger provides lift to liquids accumulated above the plunger in the wellbore, powered by gas and pressures below the plunger from formations in the earth which are in communication with the lower part of the well, below the plunger, relying on variable fluid pressures within the well-bore, above and below the plunger. The well-bore is typically lined with tubular materials of relatively uniform internal surface diameter, but operators expect the internal passageway of the tubular to be somewhat uneven or imperfect. It is optimal if the gap between the outer sides of the plunger and the inner surface of the tubular is kept small, as this will make the lift system operate more efficiently, as less pressure and fluid from beneath will bypass the plunger, and less fluid above the plunger can drop below, past the plunger. In essence, it would be ideal to have a plunger which was perfectly sealed to the tubular but moved frictionlessly along its length in either direction, powered by fluid pressure variations above and below the plunger (at least on the up-stroke lift portion of the plunger system's cycle). It is also useful to have replaceable surfaces on the outer sides of the plunger as that surface will wear from contact with the tubular's inner wall; an outer surface of different materials from the plunger's body may also be advantageous as different materials can be used to provide different structural, mass and density, permeability, chemical reactivity, formability or machineability, resilience, tooling, frictional, or wear or other characteristics as required for manufacturing, operation, assembly, repair, or function in place of different parts of the plunger.

In the prior art, a variety of mechanical plungers for use in gas-lift systems for production of fluids from wells have been disclosed or are known. Each has disadvantages. Some examples follow:

U.S. Pat. No. 6,725,916 to Gray et al. ("Gray") discloses a plunger with a system of floating, spring-loaded pads between a plunger's body and the tubular within which it operates, together with a novel seal and internal passage, with the aim of facilitating rapid descent of the plunger from its upper-most part of a stroke in its lift-cycle (by opening the inner passage at the top of the stroke, and reclosing it at the bottom). Gray provides a good example of state-of-the art pad systems. Gray's "jacket" comprises a series of interlocking pads held to the plunger's body but spring-loaded to bias outwardly toward the tubular's walls. The aspect in Gray's jacket which is relevant, is the provision of "labyrinthine passages" between the jacket's elements (the spaces between the pads), which in Gray are formed by the interlocking teeth of each pad with the adjacent pads—when the jacket (pads) is expanded, the spaces between the interlocking pads increases, providing larger and larger flow-paths for fluid communication past the plunger in the tubular during use. This is undesirable, and Gray has attempted to resolve the issue by making these passages between the interlocking pads "labyrinthine" or following a toothed, notched, or circuitous pathway. Notably, the notch-finger interlocking region between pads in Gray are also stepped and matched with a step in the extended end of each finger (and a mating void in the recess or notch into which the finger fits when assembled) which is stepped up and down in a direction radial to the linear centre of the plunger (to its longitudinal axis), while the rest of the adjacent pads' mating surface edges are not stepped in that way. While providing some resistance to fluid flow past the plunger in the annulus between the plunger and the tubular, there is still a void and passageway for fluid communication with a large cross-section.

US Patent Application 2012/0080196 by Laing ("Laing") discloses a plunger lift and safety valve system with a variable outside diameter plunger where the diameter is variable by the retraction and expansion of pads deployed about the outer circumference of the plunger's body between the plunger and the tubular (when expanded) or between the plunger and a smaller-diameter (than the tubular) safety valve (when the pads are retracted). The pads are spring-biased toward the inner surface of the tubular from the plunger, and are interlocking with each other to permit them to radially expand and contract but to be firmly held linearly in position with the plunger (linearly along the direction of the plunger's longitudinal axis). The relevance of Laing as an example of prior art plunger pad systems is that the pads interlock and are biased outwardly by springs, but when expanded the spaces between the pads open up, providing a large cross-section (viewed longitudinally along the plunger's axis to a cross-section of the plunger and pads), the openings between the pads are the relevant flow-paths for fluid flow past the plunger, which is undesirable both in terms of efficiency of operation, as well as contamination of the plunger's working parts with materials produced with the hydrocarbon fluids in the well (debris, sand, silt, corrosive materials, etc).

It is an object of the present invention to obviate or mitigate at least one disadvantage of previous related art.

SUMMARY OF THE INVENTION

Other aspects and features of the present invention will become apparent to those ordinarily skilled in the art upon review of the following description of specific embodiments of the invention in conjunction with the accompanying figures.

BRIEF DESCRIPTION OF THE DRAWINGS

In the drawings, like elements are assigned like reference numerals. The drawings are not necessarily to scale, with the emphasis instead placed upon the principles of the present invention. Additionally, each of the embodiments depicted are but one of a number of possible arrangements utilizing the fundamental concepts of the present invention. The drawings are briefly described as follows.

DESCRIPTION OF THE PREFERRED EMBODIMENT

The present invention provides an improved plunger assembly for use in downhole tubulars in wells that produce fluids and/or gases under variable pressure. In particular, the present invention provides a subassembly of expandable interlocking pad elements radially arrayed around the plunger body for sealing an annulus between the plunger and its pads and the tubular within which the plunger is deployed as part of a gas-lift system.

The present invention more specifically provides for an improved configuration of overlapped joints between adjacent pad elements which, when the pad elements are expanded within the tubular of the well, slidably sealing the plunger to the tubular. The pad elements are configured to overlap both longitudinally, by mating notch and finger joints or similar geometric arrangements, and radially, along the length of the gap or slot along the edge of each mating notch and finger by inner and outer surfaces radially spaced from the plunger's axis, such that one edge of a pad element will radially overlap the mating edge of an adjacent pad element. This can have the effect of reducing the available flowpath past the plunger along the seams between pad elements by reducing the cross-sectional surface area of the voids in those seams accessible to fluids in the annulus between the tubular and the plunger's outer surfaces when the pad elements are expanded.

When describing the present invention, all terms not defined herein have their common art-recognized meanings. To the extent that the following description is of a specific embodiment or a particular use of the invention, it is intended to be illustrative only, and not limiting of the claimed invention, which should be given the broadest interpretation consistent with the description as a whole.

Figure 1:
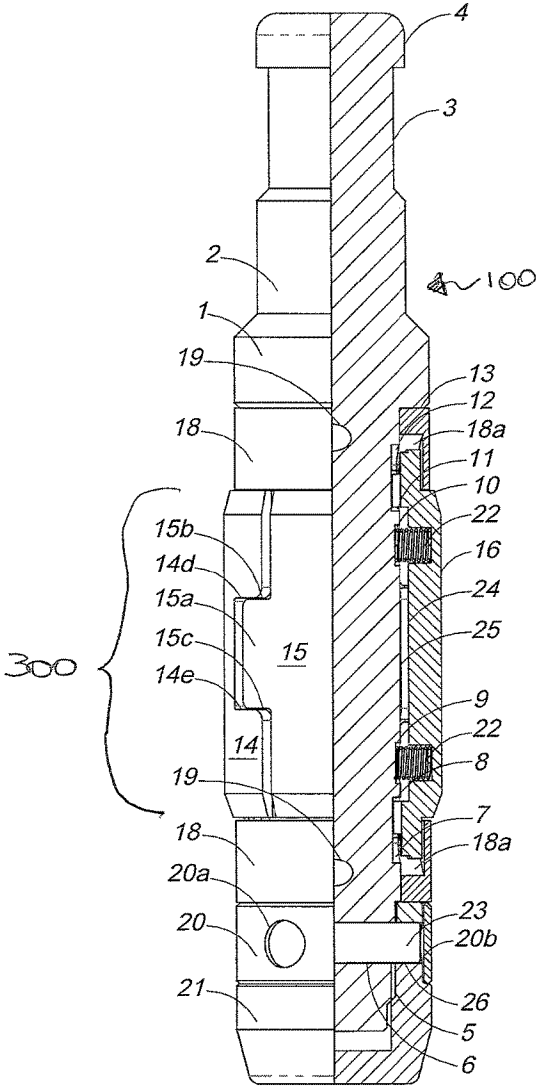
FIG. 1 is a longitudinal drawing blending a cross-section and surface elevation of a preferred assembled plunger assembly of the invention.

Referring now to FIG. 1, therein illustrated is a preferred plunger assembly of the present invention generally designated 100. The plunger assembly 100 comprises a plunger body 200 that can be composed of any rigid material, including any metal or metal alloy, rigid plastics and polymers, ceramics, etc., or any combinations thereof.

Figure 8:
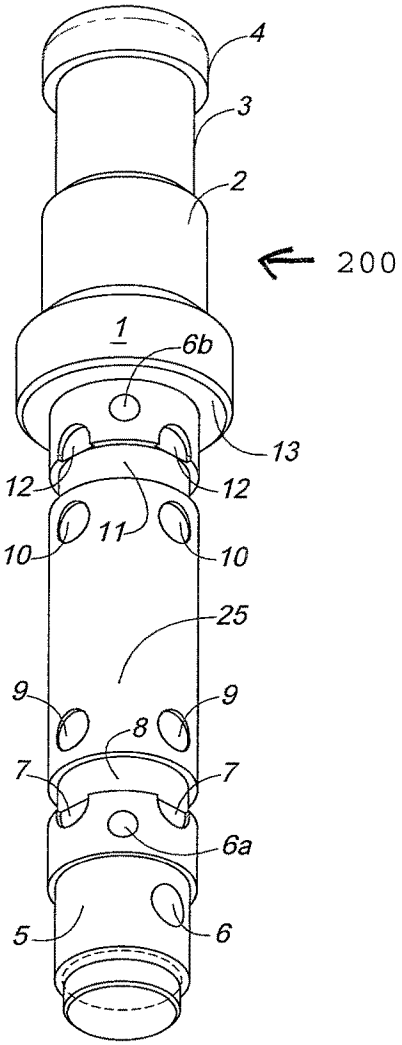

As illustrated in both FIGS. 1 and 8, the body of the plunger 200 includes an elongated central mandrel 1 for support. The mandrel 1 can be substantially cylindrical in shape and in the form of an elongated rigid non-flexible solid rod.

The plunger body 200 may include a fishing profile 2 that has a head or cap 4 located above a neck 3, as depicted in the drawings. Also illustrated in the drawings is the bottom face 13 of the fishing profile.

Referring now to FIGS. 1-7, depicted therein is the preferred pad subassembly 300 of the present invention. The pad subassembly 300 generally provides a system of expandable interlocking pad elements radially arrayed around the body of the plunger 200 for sealing the annulus between the plunger and the pad assembly and the tubular within which the plunger is deployed as part of a gas-lift system. In the preferred embodiment, four pad elements 14, 15, 16 and 17 can collectively form the pad subassembly 300. While four pad elements are depicted, the pad subassembly may comprise alternate numbers of pad elements. The pad elements can be made of any relatively rigid material such as metal or metal alloys, rigid plastics or rubber, graphite, etc, or any combinations thereof. In a preferred embodiment, the pad elements may be composed of a different material from the plunger's body 200, that may be advantageously used to provide different structural, mass and density, permeability, chemical reactivity, formability or machineability, resilience, tooling, frictional, or wear or other characteristics as required for manufacturing, operation, assembly, repair, or function, in different parts of the plunger.

The plunger's pad elements 14, 15, 16, 17 are generally adapted to engage or interlock with each other, slidably held to the plunger body 200, between the body and the inner surface of a tubular. The interlocking nature of the pad elements 14, 15, 16, 17 is both to permit the elements to move away from each other when the diameter of the assembly is expanded, and to move radially from the plunger when the diameter of the assembly is expanded.

As illustrated in the drawings, the pad elements 14, 15, 16, 17 can be generally rectangular in shape. However, the elements may be a variety of geometric shapes, sizes, and dimensions. Further, in a preferred embodiment, the pad elements 14, 15, 16, 17 may have a convex or substantially convex outer surface with a concave or substantially concave inner surface.

Figure 7:
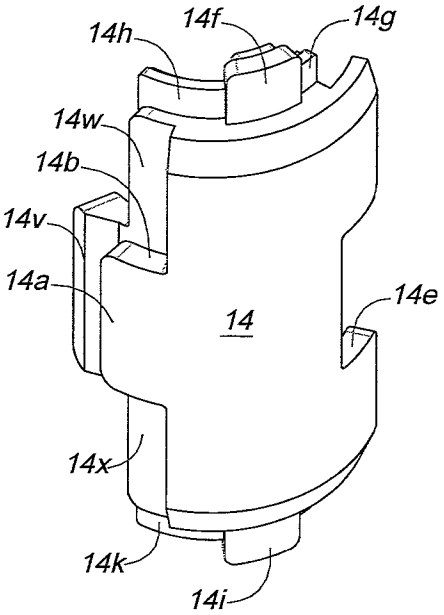
FIGS. 6 and 7 show elevations in perspective of the inner surface and the outer surface of a preferred pad element of the invention.
Figure 6:
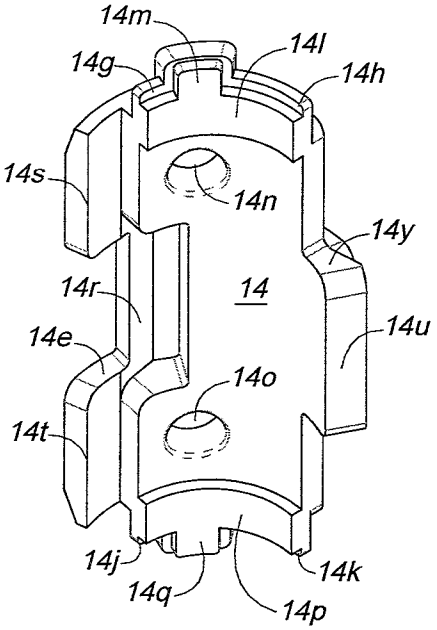

Referring now to FIGS. 6 and 7 depicted therein are elevations in perspective of the inner and outer surfaces of a preferred embodiment of one of the pad elements 14. As shown, a pad element 14 may have a generally rectangular shape having a substantially convex outer surface and a generally cylindrical inner surface.

A pad element of the present invention may comprise a tabbed or protruding portion on a first side and a notched or slotted portion on a second side, with the tabbed or slotted portion being mutually engageable with the corresponding tabbed or slotted portion of an adjacent element, so as to minimize or prevent leakage from between the elements.

As illustrated, in the preferred embodiment, the tabbed portion of the pad element 14 comprises an outer tongue 14*a* which can be defined by an upper side face 14*b* and a lower side face 14*c*, and an inner tongue 14*v* which can be defined by an upper side face 14*y* and an inner end face 14*u*. The inner tongue 14*v* may be stepped inward, such that the outer tongue 14*a* can be elevated from the inner tongue 14*v*, and the inner tongue 14*v* may extend out from the outer tongue 14*a*. Also, depicted in FIG. 7 is a side skirt upper face 14*w* and a side skirt lower face 14*x* of a pad element 14. The side skirt upper face 14*w* may be continuous with the inner tongue 14*v* and situated generally above and stepped inward from the outer tongue 14*a*, such that the outer tongue 14*a* may be elevated from the side skirt upper face 14*w*. The side skirt lower face 14*x* may be continuous with the inner tongue 14*v* and situated generally below and stepped inward from the outer tongue 14*a*, such that the outer tongue 14*a* may be elevated from the side skirt lower face 14*x*.

As illustrated in FIGS. 6 and 7, the notched portion of a pad element 14 may be defined by an upper side face 14*d* and lower side face 14*e*. Also depicted on the inner surface, is an internal face of the notch 14*r*, an internal face above the notch 14*s* and an internal face below the notch 14*t*.

Figure 2:
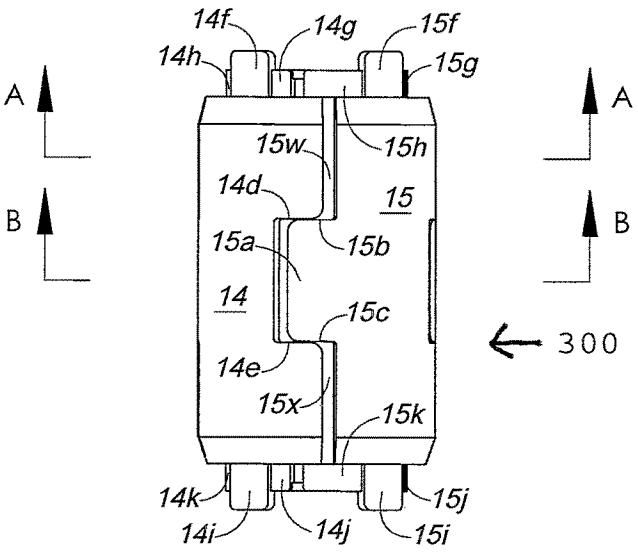
FIG. 2 shows a side elevation of the external surfaces of an exemplar of adjacent pads to show an aspect of their interlocking features.
Figure 5:
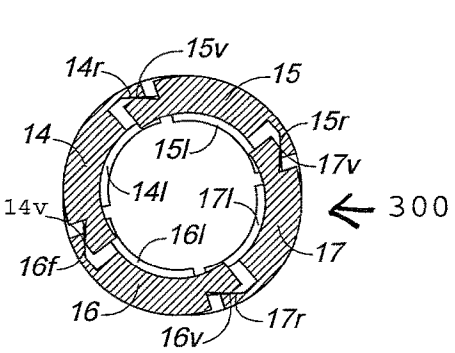
FIGS. 3, 4, and 5 show cross-sections perpendicular to the longitudinal axis of a preferred plunger assembly, each figure with a slight variant of the pads' overlap features, highlighting their approximately axial interfaces.
Figure 4:
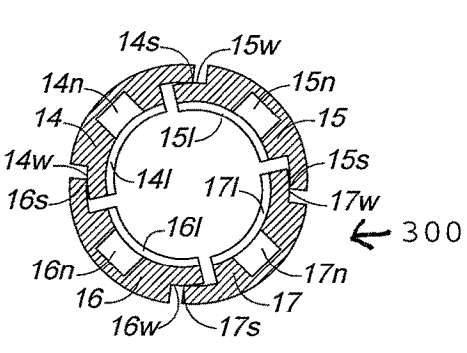
Figure 3:
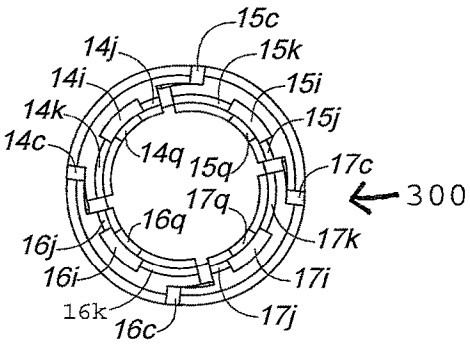

Referring now to FIGS. 2-5, depicted therein are the preferred engaging or interlocking capabilities of the pad elements of the present invention. FIGS. 3, 4, and 5 particularly depict aspects of the overlap features of pad elements 14, 15, 16, 17.

FIG. 2 is a side elevation that depicts the external surfaces of adjacent pad elements 14, 15 to show an aspect of their interlocking features. As illustrated, the outer tongue 15*b* of a pad element 15 engages or interlocks with the notch portion of an adjacent pad element 14. In particular, FIG. 2 shows the mated external surfaces between the pad elements 14, 15 as the outer tongue 15*a* of the tabbed portion engages the notched portion. As depicted, the notch upper side face 14*d* of a pad element 14 may directly contact the outer tongue upper side face 15*b* of an adjacent pad element 15. The outer tongue lower side face 15*c* may also come into direct contact with the notch lower side face 14*e*. FIG. 3 provides a bottom cross-sectional view of the pad subassembly 300 with each of its constituent pad elements 14, 15, 16, 17 as the pad subassembly 300 is expanded.

Referring now to FIG. 4, illustrated therein is a top cross-sectional view of the pad subassembly 300 of the present invention, depicting particular overlap features of adjacent pad elements 14, 15, 16, 17. More specifically, overlapping of the tabbed portion by an inner surface of the notched portion is illustrated. In the preferred embodiment depicted, there may be an overlap of the side skirt upper face 14*w*, 15*w*, 16*w*, 17*w* of a pad element by the internal face above the notch 14*s*, 15*s*, 16*s*, 17*s* of an adjacent pad element. For example, the internal face above the notch 14*s* of pad element 14 can overlap the side skirt upper face 15*w* of adjacent pad element 15. Also, as can be seen, such an overlap could be maintained even as the pad subassembly 300 was further expanded.

Referring now to FIG. 5, illustrated therein is a top cross-sectional view of the pad subassembly 300 of the present invention depicting a different aspect of the overlap features of adjacent pad elements 14, 15, 16, 17. In particular, depicted therein is the overlap of the inner tongue outer face 14*v*, 15*v*, 16*v*, 17*v* of a pad element by the notch internal face 14*r*, 15*r*, 16*r*, 17*r* of an adjacent pad element. For example, the notch internal face 14*r* of pad element 14 can overlap the outer face of the inner tongue 15*v* of adjacent pad element 15. Also, as can be seen, such overlap could be maintained even as the subassembly was further expanded.

While it may be known to have the gaps between pad elements form a labyrinthine route for fluid to flow past the plunger, by defining the gaps between the pad elements by shaping notches and fingers or tabs in the overall shapes of the pad elements as interlocking "T" shapes, or other mating and moveable geometries, the present invention provides a second type of overlap, radially between adjacent pad elements, such that the pad elements slide apart with restricted flow paths linearly along the direction of the plunger body's axis being restricted by tight gaps between adjacent pad elements' interfaces which can be perpendicular to the plunger body's axis which may not expand when the pad elements slide apart, but also providing a second slideable interface between adjacent pad elements which can overlap along a circumferential direction along a radial surface which can be within the radial depth of the pad elements, where a radially inner surface of a pad element along the gap between two pad elements can mate with a radially outer surface of an adjacent pad element along the same gap.

The pad element subassembly 300 of the present invention can be biased outwardly for slidably engaging the well tubular, while providing an external seal against the interior of the tubulars. The pad element subassembly 300 has the largest diameter of the plunger assembly when it is in its most radially expanded position and sealingly engaging the tubular. The pad elements may be biased outwardly against the tubulars by built up internal pressure and/or springs.

As illustrated in FIGS. 1 and 8, the pad subassembly of the preferred embodiment may have biasing means comprising springs 22, such as a helically wound spring, coil spring, leaf spring or any other element which has the ability to rebound or recoil after being compressed. The springs 22 may be disposed between the pump assembly body 200 and the inner surface of pad elements 14, 15, 16, 17. In a preferred embodiment, there are two springs 22 between each pad element 14, 15, 16, 17 preferably disposed at an upper end and lower end of each element. Recesses on the upper end 10 and the lower end 9 of the pump assembly 200 may accommodate and hold the spring in place. As depicted in FIG. 6, the underside of a pad element 14 may also comprise an upper spring recess 14*n* and a lower spring recess 14*o*.

The radial surface of the pad subassembly 300 may be either parallel to the outer surface of the plunger body, or may be sloped with relation to a circumferential theoretical surface within the plungers' body thickness, and if sloped, could provide a further biasing force to assist or perhaps replace some or all of the radially expanding forces typically provided by springs or other similar mechanisms (hydraulic or mechanical) between the plunger body and any or each pad element to bias the pad(s) to expand to meet the tubular.

Figure 9:
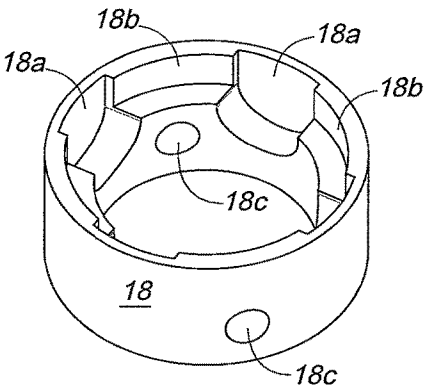
FIGS. 8 and 9 show elevations in perspective of the plunger's body and a preferred retaining means for holding the pad elements of the invention in place.

Referring back to FIG. 1, the plunger assembly 100 of the present invention comprises a pad subassembly 300 disposed about the plunger body 200 that is preferably held in place by retaining means, such as an upper and a lower retaining ring 18. FIG. 9 specifically depicts the preferred retaining means for holding the pad elements of the present invention in place. Retaining rings 18 may be substantially cylindrical in shape having a hollow inner surface of slightly larger diameter than the plunger body 200 with a shape that can correspond with that of the plunger body 200.

In a particularly preferred embodiment, the leading and/or trailing edge at the upper and/or lower end of the pad elements 14, 15, 16, 17 may be skirted to slide and seal with a retaining ring in the assembled plunger assembly 300, which may improve their seal to the plunger body 200.

As illustrated in FIGS. 6 and 7, the upper and the lower end of a pad element can comprise a corresponding upper and lower end skirt. In the preferred embodiment depicted, the upper end skirt has a notch side 14*g* and a tongue side 14*h*, whereas the lower end skirt can also comprise a notch side 14*j* and a tongue side 14*g*. The pad elements of the preferred embodiment may also comprise an upper tab 14*f* and a lower tab 14*i* which may be stepped outward from the skirt. An upper tab 14*f* may also extend generally upwards from the skirt while a lower tab 14*i* may also extend generally downwards from the skirt.

Referring back to FIG. 9, a retaining ring 18 may further comprise a plurality of end skirt recesses 18*b* for overlapping with the notch side 14*g*, 15*g*, 16*g*, 17*g* and the tongue side 14*h*, 15*h*, 16*h*, 17*h* of the upper end skirt of a pad element, with respect to an upper retaining ring 18, or the notch side 14*j*, 15*j*, 16*j*, 17*j* and the tongue side 14*k*, 15*k*, 16*k*, 17*k* of the lower end skirt of a pad element, with respect to a lower retaining ring 18. The retaining ring 18 may further comprise a plurality of pad tab recesses 18*a* that overlap a pad element upper tab 14*f*, 15*f*, 16*f*, 17*f*, with respect to an upper retaining ring 18, or a pad element lower tab 14*i*, 15*i*, 16*i*, 17*i*, with respect to a lower retaining ring

18. Also depicted is a thru bore 18*c* for a locking pin 19 for securing the retaining rings 18. As illustrated in FIG. 8, the plunger body comprises a corresponding thru bore for a lower retaining ring locking pin 6*a* and a thru bore for the upper retaining ring locking pin 6*b*.

In a preferred embodiment, the underside or inner surface of the pad element further comprises an upper and a lower rib stepped inwardly from the skirt at the upper and lower ends of the pad element, respectively. As illustrated in FIGS. 6 and 7, a pad element 14 can comprise an upper internal rib 14*l* and lower internal rib 14*p* that protrude radially inwardly toward the body 200 of the plunger. The internal ribs 14*l*, 14*p* of the preferred embodiment may further comprise a tabbed portion extending vertically from the ribs 14*l*, 14*p*. As illustrated in FIGS. 6 and 7, an upper tab internal rib 14*m* is depicted extending substantially vertically and upwards from the upper internal rib 14*l*. A lower tab internal rib 14*q* is also depicted extending substantially vertically and downwards from the lower internal rib 14*p*.

The plunger assembly of the present invention may further comprise a bottom sub 21 on the bottom end of the plunger body 200, as illustrated in FIG. 1. The bottom sub 21 may have tapered end. Referring also to FIG. 8, illustrated therein is a threaded connection 5 a bottom sub locking pin 23 and thru bore for the locking pin 6.

In the preceding description, for purposes of explanation, numerous details are set forth in order to provide a thorough understanding of the embodiments of the invention. However, it will be apparent to one skilled in the art that these specific details are not required in order to practice the invention.

The above-described embodiments of the invention are intended to be examples only. Alterations, modifications and variations can be effected to the particular embodiments by those of skill in the art without departing from the scope of the invention, which is defined solely by the claims appended hereto.

LEGEND FOR DRAWINGS

Legend for FIGS. 1-9

1. Mandrel
2. Fishing Profile (contains 3 and 4)
3. Fishing Neck
4. Fishing Head or Cap
5. Bottom Threaded Connection
6. Thru Bore for Bottom Sub Locking Pin
  6*a*. Thru Bore for lower Retaining Ring locking pin
  6*b*. Thru bore for upper Retaining Ring locking pin
7. Lower Tab (14Q) recess
8. Lower pad internal rib (14*p*) recess
9. Pad coil spring recess lower end
10. Pad coil spring recess upper end
11. Upper pad internal rib (14L) recess
12. Upper pad tab (14*m*) recess
13. Fishing Profile bottom face
14. Plunger Pad Element
  a. Outer tongue
  b. Outer tongue upper side face
  c. Outer tongue lower side face
  d. Notch upper side face
  e. Notch lower side face
  f. Pad upper tab outer surface
  g. Upper end skirt notch side
  h. Upper end skirt tongue side
  i. Pad lower tab outer surface
  j. Lower end skirt notch side
  k. Lower end skirt tongue side
  l. Upper internal rib
  m. Upper tab internal rib
  n. Upper coil spring recess
  o. Lower coil spring recess
  P. Lower internal rib
  q. Lower tab internal rib
  r. Notch internal face
  s. Internal face above notch
  t. Internal face below notch
  u. Inner tongue end face
  v. Inner tongue outer face
  w. Side skirt upper face
  x. Side skirt lower face
  y. Inner tongue upper side face
15. Plunger Pad Element
  a. a thru y same as for 14
16. Plunger Pad Element
  a. a thru y same as for 14
17. Plunger Pad Element
  a. a thru y same as for 14
18. Retaining Ring
  a. Pad tab recess (overlaps 14*f* or 14*i*)
  b. End skirt recess (overlaps 14*j* & 14*k* or 14*g* & 14*h*)
  c. Thru bore for locking pin
19. Locking pin for retaining ring (18)
20. Lock ring for bottom sub locking pin (23)
  a. Lock ring access hole for locking pin
  b. Lock ring interior surface
21. Bottom sub
22. Pad coil spring
23. Bottom sub locking pin
24. Pad internal face
25. Mandrel face
26. Bottom sub thru bore for locking pin

What is claimed is:

1. A plunger assembly for use in a gas/fluid lift system in a well, comprising:

a plunger body;

a pad subassembly having a plurality of pad elements disposed about the body, each of the pad elements having an outer surface and an inner surface, first and second sides, and top and bottom ends;

the pad subassembly biased to move radially outward from the plunger body such that the pad subassembly can expand outwardly from the plunger body for providing an external seal against the interior of the well's tubulars;

the first and second sides of the pad elements having engaging means for mating with corresponding engaging means of an adjacent pad element for reducing fluid communication parallel to the plunger body longitudinal axis;

wherein the engagement mating means are overlapping mated surfaces between the pads to engage and form slidable slideable seals which are both axial to the plunger body and radial to the plunger body and are continuous along an edge of a joint between adjacent pad elements;

the engaging means allowing a radial inner surface of each pad element along a gap between the adjacent pad element to mate with a radial outer surface of the adjacent pad element along an entire edge of the gap;

the engaging means being a tabbed portion on the entire first side of each pad element and a notched portion on the entire second side of each pad element, the tabbed portion being mutually engageable with the notched portion of the adjacent pad element along an entire edge of the joint between adjacent pads;

the tabbed portion having an outer tongue and an inner tongue, the inner tongue being stepped inward and extending out from the outer tongue; and at least one inner surface of the notched portion of each pad element overlapping with at least one external surface of the tabbed portion of the adjacent pad element, which overlap is maintained even when the pad subassembly is further expanded.

2. The plunger assembly of claim 1, wherein the inner surface of the notched portion has an internal face above the notch and the external surface of the tabbed portion has a side skirt upper face.

3. The plunger assembly of claim 2, wherein the internal face above the notch overlaps the side skirt upper face.

4. The plunger assembly of claim 1, wherein the inner surface of the notched portion has a notch internal face and the external surface of the tabbed portion has an inner tongue outer face, wherein the notch internal face overlaps the inner tongue outer face.

5. The plunger assembly of claim 1, wherein the inner surface of the notched portion has an internal face above the notch and a notch internal face and the external surface of the tabbed portion has a side skirt upper face and an inner tongue outer face, wherein the internal face above the notch overlaps the side skirt upper face and the notch internal face overlaps the inner tongue outer face.

6. The plunger assembly of claim 1, wherein the pad subassembly comprises four pad elements.

7. The plunger assembly of claim 1, wherein the pad subassembly is composed of a different composition than the plunger body.

8. The plunger assembly of claim 1, wherein the pad elements have a T-shaped configuration.

9. The plunger assembly of claim 1, further comprising at least one retaining means which limits the outward radial movement of the pad elements, wherein the retaining means is a retaining ring having a hollow inner surface being adjacent to the top end of the pad elements or being adjacent to the bottom end of the pad elements, wherein the upper or the lower end of the pad elements area skirted so as to engage with the retaining ring and be expandably retained proximate to the plunger body.

10. The plunger assembly of claim 9, wherein the retaining means is upper and lower retaining rings having a hollow inner surface, the upper retaining ring being adjacent to the top end of the pad elements and the lower retaining ring being adjacent to the bottom end of the pad elements, wherein the upper and the lower end of the pad elements are skirted, such that the upper end of the pad elements engage with the upper retaining ring and the lower end of the pad elements engage with the lower retaining ring, and where the engagement of each pad element's ends with a retaining ring forms a slidable fit to restrict fluid flow past the retaining ring and pad into a space between the pad and plunger body.

11. The plunger assembly of claim 1, further comprising at least one biasing means disposed between the pad elements and the plunger body and biasing the elements outwardly from the plunger body.

12. The plunger assembly of claim 11, wherein the biasing means comprises one or more springs.

13. The plunger assembly of claim 11, wherein the springs are disposed at an upper and a lower end of each pad element.

* * * * *